United States Patent [19]

Galow et al.

[11] 4,321,112

[45] Mar. 23, 1982

[54] DEVICE FOR OPENING, CLOSING AND CLEANING FILL HOLES OF COKE OVEN CHARGEABLE BY A COAL CONVEYOR

[75] Inventors: Manfred Galow, Essen; Klaus Dahl, Gelsenkirchen; Wolfgang Rohde, Essen; Diethard Habermehl, Essen; Werner Kucharzyk, Essen; Werner Siebert, Essen, all of Fed. Rep. of Germany

[73] Assignee: Bergwerksverband GmbH, Essen, Fed. Rep. of Germany

[21] Appl. No.: 257,404

[22] Filed: Apr. 24, 1981

[30] Foreign Application Priority Data

Apr. 29, 1980 [DE] Fed. Rep. of Germany ..... 3016418

[51] Int. Cl.[3] ..... C10B 25/20; C10B 31/02; C10B 43/04

[52] U.S. Cl. ..... 202/241; 15/93 A; 414/164; 202/251; 202/262

[58] Field of Search ..... 202/241, 251, 262; 414/164; 15/93 A

[56] References Cited

U.S. PATENT DOCUMENTS

| | | | |
|---|---|---|---|
| 873,647 | 12/1907 | Young et al. | 202/251 |
| 913,552 | 2/1909 | Parker | 202/251 |
| 1,824,853 | 9/1931 | Wells | 414/164 |
| 3,160,573 | 12/1964 | Nepomniashtshy | 202/241 |
| 3,709,387 | 1/1973 | Kinzler et al. | 202/262 |

*Primary Examiner*—Bradley Garris

*Attorney, Agent, or Firm*—Michael J. Striker

[57] ABSTRACT

A device for opening, closing and cleaning fill holes of a coke oven comprises a self-supporting carrying frame extending above the fill holes and supporting a runway for an overhead crane and further supports spring-biased bell seals for respective fill holes; a manipulation unit is suspended on the crane and includes a vertical thrust drive and a rotary drive coupled respectively to a manipulation head which is driven into engagement with actuation means for respective bell seals to selectively open and close the bell and to rotate simultaneously cleaning knives in each fill hole.

12 Claims, 5 Drawing Figures

DEVICE FOR OPENING, CLOSING AND CLEANING FILL HOLES OF COKE OVEN CHARGEABLE BY A COAL CONVEYOR

BACKGROUND OF THE INVENTION

The present invention relates in general to coke ovens and in particular to a device for opening, closing and cleaning fill holes of coke ovens of the type having the fill holes provided in the top cover and being chargeable by a coal conveyor, each fill hole being provided with a bell seal, a spring for holding the seal in its closing position, an actuation member for the bell seal, and a pair of juxtaposed cleaning knives arranged in the range of the bell seal for rotary movement in the fill hole.

SUMMARY OF THE INVENTION

A general object of the present invention is to provide a device for the coke ovens of the above described type in which all three aforementioned processes, namely the opening and closing of the bell seals and the cleaning of the fill hole from the side of the coking chamber are made possible with low construction expenditures.

An additional object of the invention is to provide such an improved device which is simple to manipulate.

In keeping with these objects, and others which will become apparent hereafter, one feature of the invention resides, in a coke oven of this type, in the provision of a carrying frame on top of the oven structure, a manipulation unit supported on the carrying frame for movement above the actuation members of respective bell seals, the manipulation unit including a thrust-and-turn head engageable with a selected actuation member, a linear drive means for thrusting the head against the spring of the bell seal, and a rotary drive means for imparting a rotary movement to the head.

The device according to this invention enables by combining rectilinear and rotary movements a simple solution of the objectives of this invention. The axial movement of the head introduced by the rectilinear drive controls the closing and opening of the bell seal, while the rotary drive achieves simultaneous cleaning of the wall of the fill hole at the side of the coking chamber. During the downward movement of the thrust-and-turn head, the latter first engages the actuation means for the bell seal and displaces the same against biasing spring to move the bell seal into its open position. When the head is moved upwardly, the actuation member which is supported on the biasing spring is returned by the latter into its initial position in which the bell seal closes the fill hole. During the vertical movement in both directions, the thrust-and-turn head is capable of performing the rotary movement induced by the rotary drive to facilitate the pair of cleaning knives about their axes of symmetry. The cleaning knives are mounted on the actuation member for the bell seal at the level of the fill holes and thus perform the cleaning process. Both drives, that is the thrust drive and the rotary drive, can include hydraulic or pneumatic or electric driving means.

In the preferred embodiment of this invention, the actuation member for the bell seal is a projecting pin supported on the biasing spring and connected to the bell of the seal whereby the tip of the pin has a conical configuration. The thrust-and-turn head is formed with a matching inner cone which abuts against the corresponding tip of the actuation pin.

The pin has radially directed projections or lugs which are received in corresponding cut-outs in the head and carry the pin for rotation.

In the preferred embodiment of this invention, the thrust or rectilinear drive is in the form of a cylinder-and-piston unit.

In another modification the piston rod of the cylinder-and-piston unit is formed with a bore for guiding a square fitting piece which serves for the transmission of the rotary movement from the rotary drive.

In another modification, the manipulation unit is mounted on a movable platform capable of moving in all directions in a horizontal plane so that any inaccuracies in the location of the filling holes on the coke oven roof amounting for example to ±20 mm or more can be compensated.

Preferably, the moving platform for the manipulation unit is centered by means of a set of biasing springs which permit the desired deviation of the head from its central position, and upon withdrawal of the thrust and turn head from the actuation pin they automatically reset the platform and the head into their initial position until the head is brought into engagement with another actuation means in the next fill hole.

Preferably, the all-directional movability of the platform for the head is achieved in a very simple manner by providing two carriages movable on rollers relative to each other in two perpendicular directions.

The displacement of the device of this invention from one fill hole to another is made preferably by installing the device on a travelling crane which is suspended for movement on rails mounted parallel to the top cover of the oven on the carrying frame. Due to the free suspension of the device of this invention, the oven roof is not exposed to the load and reaction forces generated during the operation of the device of this invention.

Preferably, the travelling crane is suspended on rollers running between two superposed rails mounted on the carrying frame and guided by means of two lateral flanges engaging the sides of the rails. By means of this particular overhead suspension a swing-free travel and transmission of reaction forces during the opening of the bell seal is ensured.

In addition, the device of this invention is provided with additional lateral guiding rollers engaging a guiding rail mounted on the carrier frame so that any lateral swing of the device is eliminated.

Furthermore, the carrier frame for the device of this invention is equipped with a bottom spring stop for the biasing spring of the bell seal, so that no load is applied on the roof or top cover of the coke oven during the opening or closing of the fill holes.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
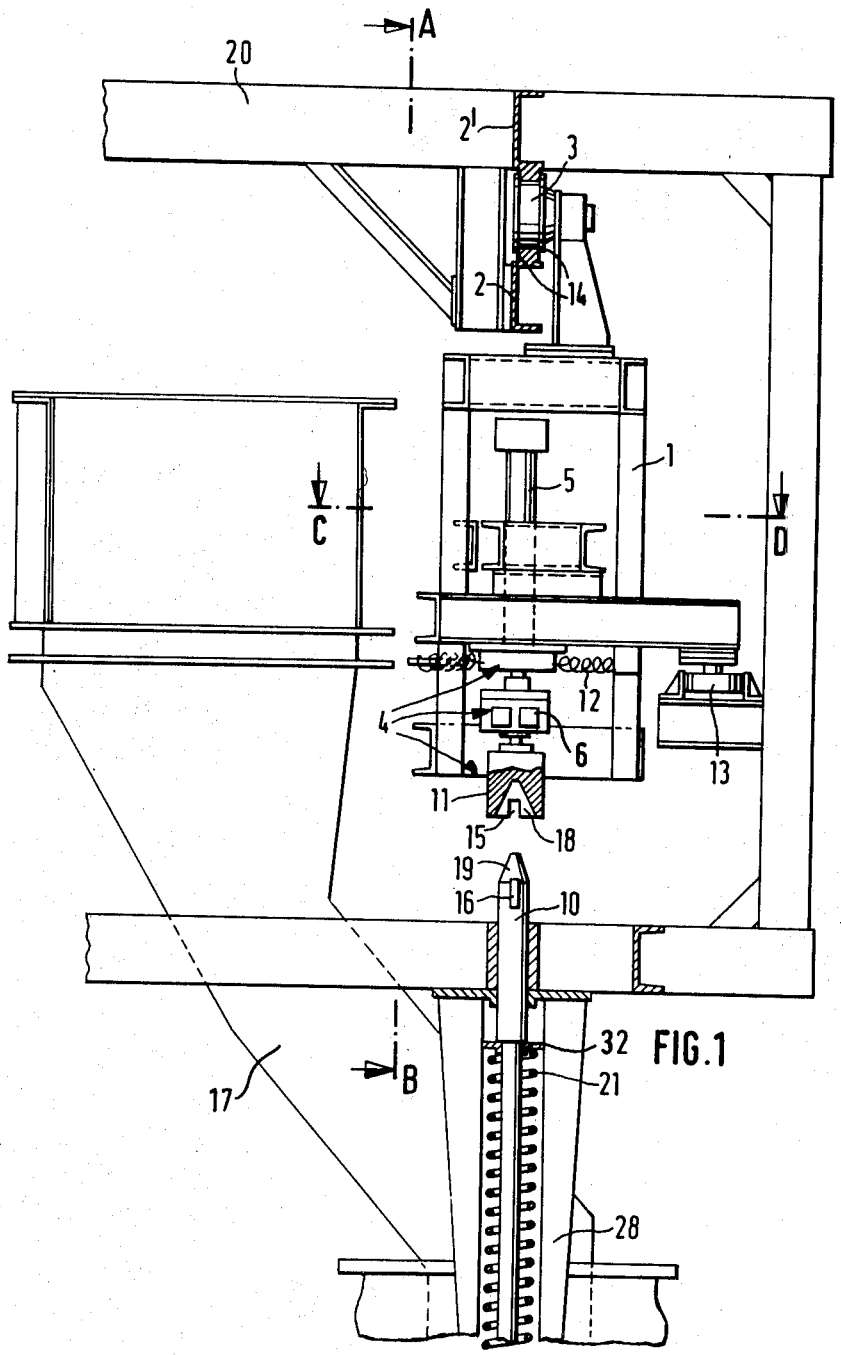
FIG. 1 is a side view, partly in section, of the device of this invention including its suspension means.
Figure 2:
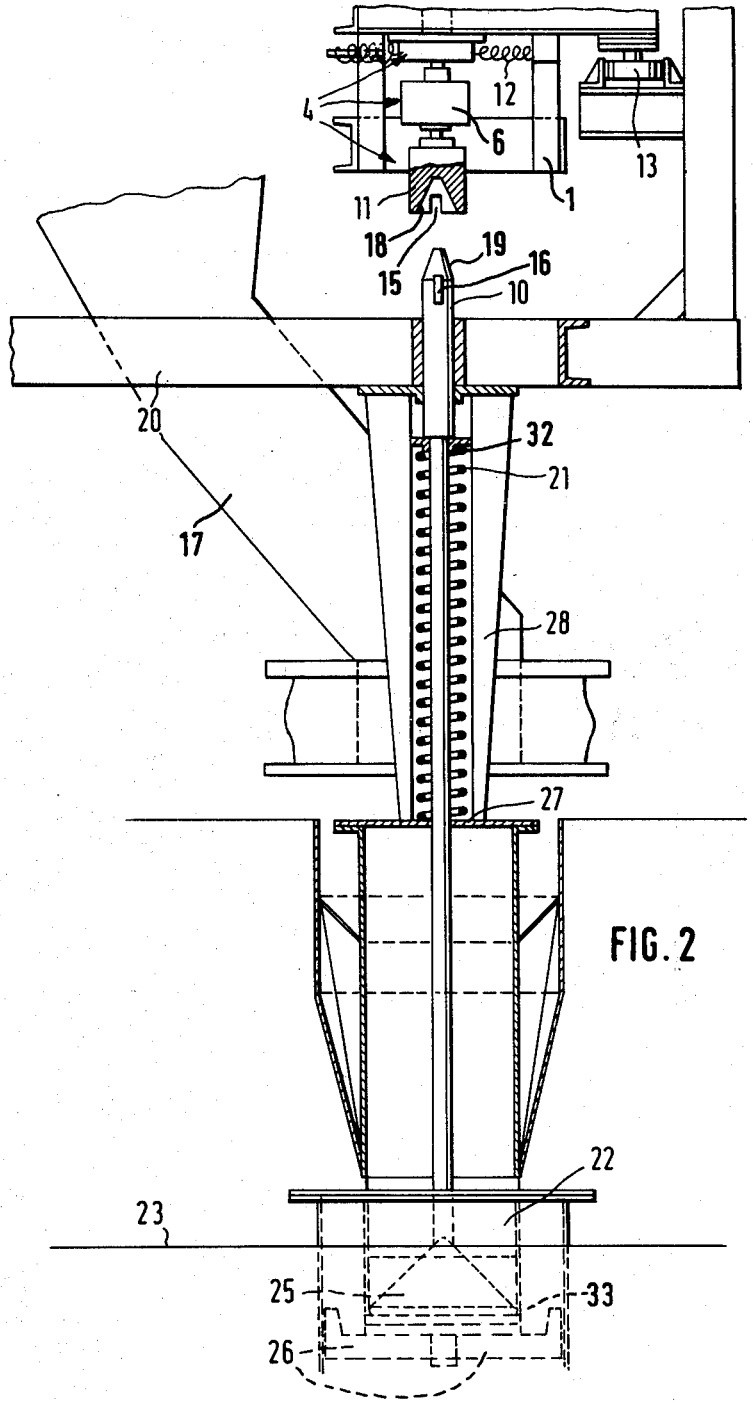
FIG. 2 is a view similar to that of FIG. 1 showing in section actuating member for the bell seal of a fill hole in a coke oven.
Figure 3:
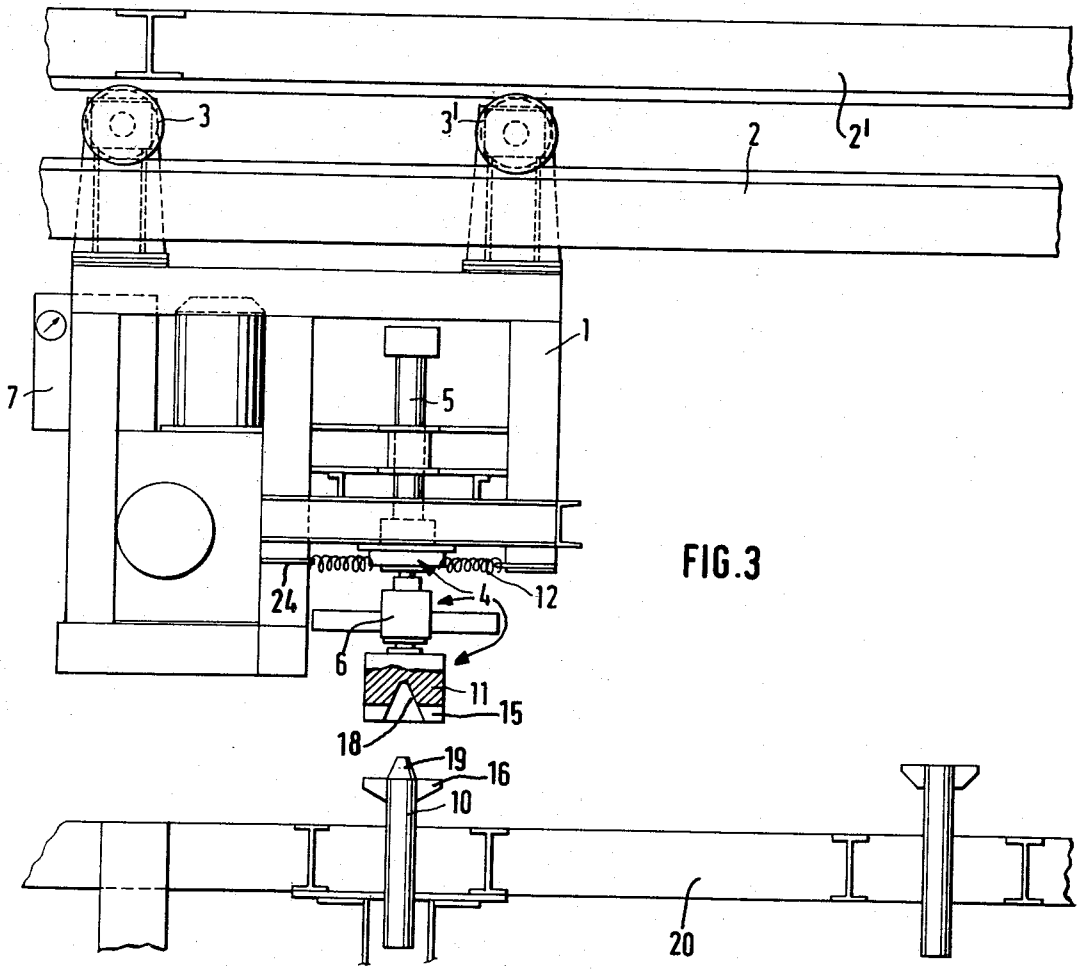
FIG. 3 is a front view of the device of FIG. 1 taken along the line A—B.

Referring firstly to FIGS. 1, 2 and 3, the device for opening, closing and cleaning fill holes 22 (FIG. 2) arranged in a top cover 23 of a coke oven battery is installed in a holding frame in the form of a travelling crane 1. The travelling crane 1 is suspended by means of a pair of rollers 3 and 3' (FIG. 3) between two guide rails 2 and 2' fixed one above the other to a carrier frame 20 which is self-supported above the roof or cover plate 23 of the coke oven battery. The two runway rails 2 and 2' extend parallel to the series of respective fill holes 22.

Crane rollers 3 and 3' are formed with lateral flanges or rims 14 engaging both guiding rails 2 and 2' so as to preclude derailment and to intercept reaction forces resulting during operation of the manipulation unit 4 installed in the crane carriage 1.

The manipulation unit 4 comprises a hydraulically driven cylinder-and-piston unit acting as a vertical rectilinear drive 5 which is coupled at its lower end to a rotary drive 6 which can be also hydraulically operated to rotate the rectilinear thrust drive 5 about a vertical axis by 360°. Piston rod 30 of the cylinder-and-piston unit in the drive 5 has a square central bore for accommodating a square fitting piece 29 which transmits to the piston rod 30 the torque from the rotary hydraulic drive 6. Both the linear or thrust drive 5 in the form of the cylinder-and-piston unit and the hydraulic rotary drive 6 operate for example with a working pressure of about 100 bars generated in a hydraulic station 7 which is also installed in the carriage 1 (FIG. 3). The driving shaft of the rotary drive 6 is journalled in a roller bearing which is designed also to take thrust loads in axial direction from the linear drive 5. The driving shaft of the rotary drive 6 is provided with a threaded end.

Figure 4:
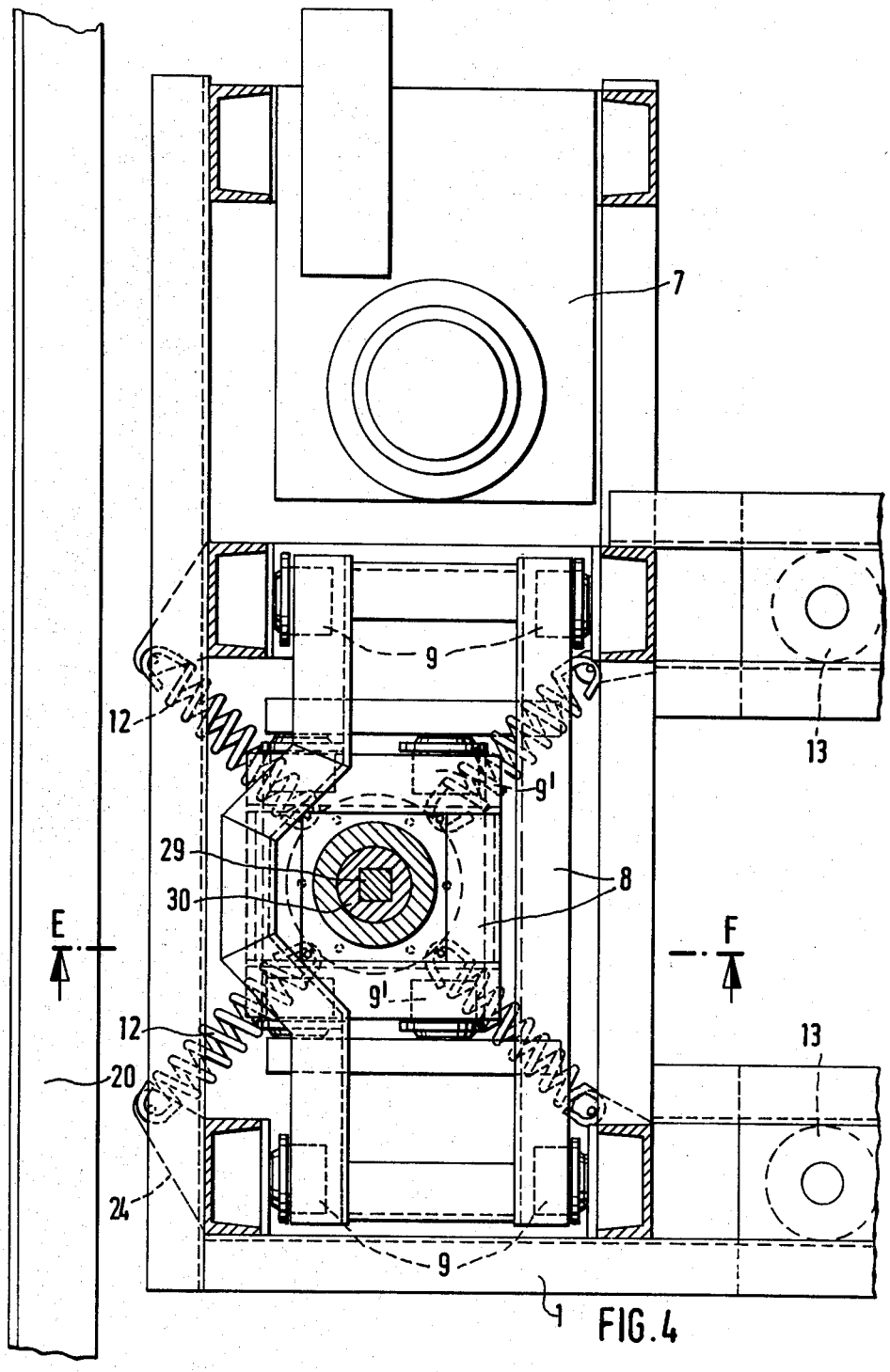
FIG. 4 is a sectional top view of the device of FIG. 1 taken along the line C—D.
Figure 5:
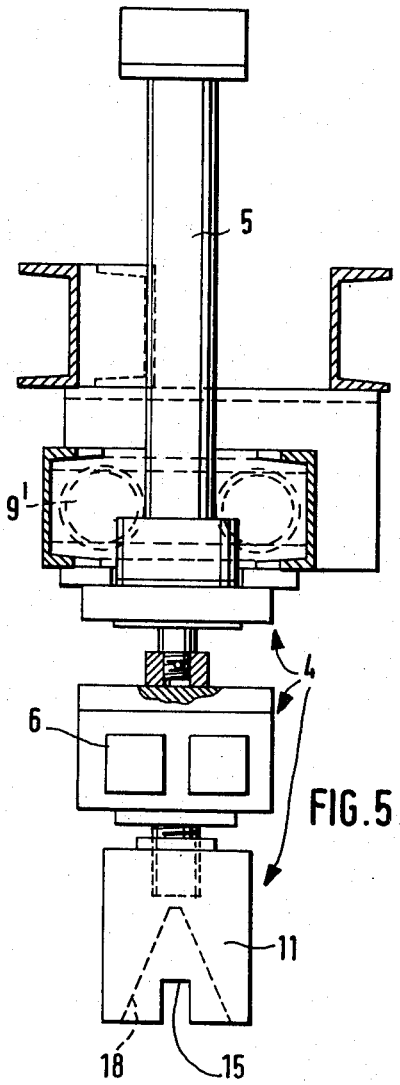
FIG. 5 is a sectional side view taken along the line E—F in FIG. 4.

The manipulation unit 4 together with its hydraulically operated linear drive 5 acting in vertical direction and hydraulically operated rotary drive 6 acting in a horizontal plane is mounted on a horizontally movable platform 8 (FIG. 4) which is supported for movement in all horizontal directions. This support consists of two pairs of guide rails cooperating with corresponding sets of rollers 9 and 9' so that one set of rollers 9 supports the platform for movement in one direction and the other set of rollers 9' supports the platform in perpendicular directions. The resulting combined movement in the horizontal plane enables a reliable alignment of a thrust-and-turn head 11 fastened to the projecting driving pin of the unit 4 with the conical end 19 of an actuation pin 10 for the bell seal closure 25 in the fill hole 22. The lower end of the actuation pin 10 is connected to the sealing bell 25 and to a pair of juxtaposed cleaning knives 26 corresponding in diameter to the clearance of the feed passage. The immediate centering of the thrust-and-turn head 11 on the conical tip of pin 10 is effected by a matching conical recess 18 in the lower face of the head 11, whereby the base of the conical recess exceeds in diameter the base of the conical tip 19 of pin 10. In addition, head 11 in the range of conical recess 18 is formed with two opposite radial recesses 15 which are engageable with corresponding radial projections or lugs 16 on the actuation pin 10. Upon activating the rotary drive 6, the radial recesses 15 in connection with the lugs 16 rotate also via the seal actuation pin 10 the cleaning knives 26.

The horizontally movable platform 8 is held in its rest position by a set of four tension springs 12 forming with each other an angle of 90° and being attached to brackets 24 on the frame of carriage 1. To prevent lateral swinging of carriage 1, the carrier frame is also formed with a guiding rail which engages guiding rollers 13 mounted on an arm projecting laterally from the frame of carriage 1.

As mentioned before, the actuation pin 10 serves for opening and closing bell seal 25 in the fill hole 22, on the one hand, and for rotating cleaning knives 26 engaging the inner wall of the feeding passage into the coking chamber. The intermediate part of the seal actuation pin 10 is reduced in diameter, and the resulting step 32 abuts against a spring plate of a pressure spring 21 which at its other end rests on an abutment 27 which is connected by means of vertical spacing ribs 28 to the carrying frame 20. The pressure spring 21 thus normally urges via the actuation pin 10 the sealing bell 25 upwardly into its closing position in contact with the edge 33 of filling hole 22. FIGS. 1 and 2 also illustrate the spatial relationship between the device of this invention and a charging chute 17 for the coke oven.

In operation, the crane carriage 1 is first displaced by a non-illustrated hydraulic, pneumatic or electric drive into an operative position above a fill hole 22. Thereupon, the cylinder-and-piston unit of thrust drive 5 is activated and displaces the thrust-and-turn head 11 downwardly in a first stroke portion of about 160 mm for example. Conical recess 18 in head 11 is thus brought into engagement with the conical tip 19 of the actuation pin 10 and presses the same downwardly to move the sealing bell 25 into its open position. Upon completion of the first downward stroke, the rotary drive 6 is activated for example by means of a limit switch and a timing relay. During the time interval determined by the timing relay, head 11 performs a combined movement, namely an additional downward stroke for about 140 mm together with the rotation introduced by the drive 6. The speed of the downward stroke is for example 0.05 meters per second. After completion of the total downward stroke by the cylinder-and-piston unit 5, rotary drive 6 remains in function and consequently the cleaning knives 26 keep rotating. At the same time, filling hole 22 is open and ready for the charging process via the feeding chute 17. Upon completion of the charging process, a control knob is actuated to initiate an upward or return stroke of the piston of the vertical drive 5. During the first part of the return stroke, amounting for example to 140 mm, the aforementioned limit switch sets the timing relay to its zero position and turns off rotary drive 6, thus terminating the cleaning action of cleaning knives 26. The remaining 160 mm part of the upward stroke up to the rest position of the drive 5 is thus made without any rotary movement. In the rest position, the cylinder-and-piston unit of drive 5 is locked via another limit switch by hydraulic, pneumatic or electric locking means. The hydraulically operated cylinder-and-piston unit 5, as well as the hydraulically activated rotary drive 6, are preferably equipped with pressure-limiting valves. In addition, the rotary drive is equipped with a flow-regulating valve for controlling the rotary speed. The valves can be designed preferably with emergency actuation means or with return springs.

It will be understood that each of the elements described above, or two or more together, may also find a useful application in other types of constructions differing from the types described above.

While the invention has been illustrated and described as embodied in a device for use with coke ovens, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In combination, a device for opening, closing and cleaning fill holes and a coke oven structure of the type having the fill holes arranged in its top cover and being chargeable by a coal conveyor, each fill hole being provided with a bell seal, a spring for urging the bell seal into its closing position, an actuation member connected to said bell seal, and a pair of juxtaposed cleaning knives arranged on said actuation member in the range of the bell seal for rotation in said fill hole, the device comprising a self-supporting carrying frame extending above said top cover of the oven, a manipulation unit supported on said carrying frame for movement above said actuation members of respective bell seals, said manipulation unit including a thrust-and-turn head engageable with an actuation member, a vertical linear drive for imparting a reciprocating vertical movement to said head, and a rotary drive means for imparting a rotary movement to said head in addition to said vertical movement.

2. A device as defined in claim 1, wherein said actuation member is a pin guided for reciprocating vertical movement in said carrier frame and having at its upper end a conical tip, and said head being provided with a matching conical recess to engage said tip.

3. A device as defined in claim 2, wherein said pin further includes radially projecting lugs and said head has corresponding radial recesses in the range of said conical recess to engage and carry said lugs.

4. A device as defined in claim 1, wherein said linear drive is a hydraulic or pneumatic cylinder-and-piston unit.

5. A device as defined in claim 4, wherein said cylinder-and-piston unit includes a piston rod provided with a central bore for accommodating a fitting square piece coupled to said rotary drive means.

6. A device as defined in claim 1, wherein said manipulation unit is supported on a platform movable in all directions on a horizontal plane and being supported on said carrying frame.

7. A device as defined in claim 6, wherein said platform is resiliently centered in a rest position by a set of counteracting springs connected to said carrying frame.

8. A device as defined in claim 7, wherein the platform is displaceable on two pairs of mutually crossing runway rails.

9. A device as defined in claim 1, wherein said carrying frame includes an overhead runway track extending parallel to said fill holes, and a travelling crane movable on said runway track and supporting said manipulation unit.

10. A device as defined in claim 9, wherein said runway track is assembled of two superposed rails and said crane includes running rollers each being provided with lateral flanges engaging said rails.

11. A device as defined in claim 10, further including an additional guiding rail attached on said carrying frame, and said manipulation unit including lateral rollers engaging said guiding rail to prevent lateral swing of said crane.

12. A device as defined in claim 1, wherein said spring is supported at its lower end on an abutment secured to said carrying frame above said fill hole and engaging at its other end said actuation member.

* * * * *

UNITED STATES PATENT AND TRADEMARK OFFICE

CERTIFICATE OF CORRECTION

PATENT NO. : 4,321,112

DATED : March 23, 1982

INVENTOR(S) : Manfred Galow et al.

It is certified that error appears in the above-identified patent and that said Letters Patent are hereby corrected as shown below:

On the title page the assignees should read:

-- Bergwerksverband GmbH and Didier Engineering GmbH, both of Essen, Federal Republic of Germany --.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*